US006851800B1

(12) United States Patent
Seu

(10) Patent No.: US 6,851,800 B1
(45) Date of Patent: Feb. 8, 2005

(54) PRINT CARTRIDGE BODIES

(75) Inventor: Preston Seu, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 22 days.

(21) Appl. No.: 10/629,204

(22) Filed: Jul. 29, 2003

(51) Int. Cl.[7] ..... B41J 2/175
(52) U.S. Cl. ..... 347/86; 347/87
(58) Field of Search ..... 347/43, 49, 86, 347/87

(56) References Cited

U.S. PATENT DOCUMENTS 4,771,295 A * 9/1988 Baker et al. ..... 347/87
5,497,178 A 3/1996 DeFosse et al.
5,576,750 A 11/1996 Brandon et al.
5,926,195 A 7/1999 Domhoff et al.
6,260,961 B1 7/2001 Seu et al.
6,302,530 B1 * 10/2001 Shimada et al. ..... 347/86
6,331,054 B1 12/2001 Seu et al.
6,527,382 B2 * 3/2003 Hou et al. ..... 347/87

* cited by examiner

*Primary Examiner*—Anh T. N. Vo

(57) ABSTRACT

A single-piece print cartridge body is provided. The print cartridge has a plurality of outlet ports disposed along a single axis that is substantially perpendicular to a direction of motion of the print cartridge body during printing. First and second compartments are respectively communicatively coupled to first and second cavities. The first and second cavities are substantially parallel to the single axis and are located on opposite sides of the single axis. A first channel interconnects the first cavity and a first one of the plurality of outlet ports. A second channel interconnects the second cavity and a second one of the plurality of outlet ports. The first and second channels are substantially perpendicular to the single axis.

44 Claims, 12 Drawing Sheets

PRINT CARTRIDGE BODIES

FIELD OF THE INVENTION

The present invention relates generally to print cartridges.

BACKGROUND

Many imaging devices, such as printers, facsimile machines, etc., employ an ink-jet cartridge for printing on a printable medium, such as paper. During printing, the ink-jet cartridge moves across the printable medium while depositing images on the printable medium. Many inkjet cartridges include a print head and a body. The body usually has an ink reservoir and an ink delivery channel for delivering ink from the ink reservoir to the print head. Print heads usually include a print-head die, e.g., formed on a substrate of silicon or the like using semi-conductor processing methods, such as photolithography or the like. Printhead dies typically include a slot for receiving ink from the ink reservoir via the ink delivery channel. Many print-head dies also include resistors for vaporizing ink received from the slot. This causes the ink to be ejected through a set of orifices of the print head so as to print dots of ink on the printable medium.

Multicolored ink-jet cartridges are used for color ink-jet printing. Multicolored ink-jet cartridges usually include a body having a plurality of ink reservoirs, each for containing a different colored ink, and an ink delivery channel connected to each of the ink reservoirs. Many multicolored ink jet cartridges also include a print head having a print head die with plurality of slots respectively connected to a different one of the plurality of ink reservoirs via the ink delivery channel of the respective ink reservoir. Each of the slots respectively delivers ink to different a set of resistors of the print head die for vaporization and subsequent ejection through a corresponding set of orifices of the print head.

In one application, a multicolored ink-jet cartridge has a print head with a print head die having slots aligned on a single axis that is perpendicular to the direction of motion of the ink-jet cartridge during printing. This is known to improve print quality and to reduce the size, and thus the cost, of the print-head die. Each of the slots of the print head die respectively aligns with a different outlet port of the cartridge body. Consequently, the cartridge body has multiple outlet ports aligned on the single axis. Each of the of outlet ports is respectively connected to a different ink reservoir of the cartridge body by an ink delivery channel.

Some of these ink-jet cartridges have an ink reservoir located on either side of the single axis, and the ink delivery channel of the ink reservoir on either side of the single axis forms an angle with respect to the single axis. The cartridge body is usually a one-piece injection-molded part, and a mold-slide-insert forms the ink delivery channel on either side of the single axis during molding. This typically requires two mold-slide-inserts, one for the channel ink delivery channel on either side of the single axis. After molding, one of the two mold-slide-inserts extends through the cartridge body on one side of the single axis, and the other extends through the cartridge body the other side of the single axis. The two mold-slide-inserts are removed from the body, leaving behind two openings (or mold-slide-insert access holes) in the cartridge body on either side of the single axis. A plug subsequently seals each mold-slide-insert access hole.

Using two mold-slide-inserts as described above often requires using relatively slender mold-slide-inserts that can be fragile and susceptible to excessive creep and that may require excessive maintenance. Moreover, the use of two plugs and two mold-slide-inserts can be costly from a manufacturing standpoint.

For the reasons stated above, and for other reasons stated below that will become apparent to those skilled in the art upon reading and understanding the present specification, there is a need in the art for the present invention.

SUMMARY

One embodiment of the present invention provides a single-piece print cartridge body having a plurality of outlet ports disposed along a single axis that is substantially perpendicular to a direction of motion of the print cartridge body during printing. First and second compartments are respectively communicatively coupled to first and second cavities. The first and second cavities are substantially parallel to the single axis and are located on opposite sides of the single axis. A first channel interconnects the first cavity and a first one of the plurality of outlet ports. A second channel interconnects the second cavity and a second one of the plurality of outlet ports. The first and second channels are substantially perpendicular to the single axis. In another embodiment, a third compartment is connected to a third one of the plurality of outlet ports by a third channel.

DETAILED DESCRIPTION

In the following detailed description of the present embodiments, reference is made to the accompanying drawings that form a part hereof, and in which is shown by way of illustration specific embodiments in which the invention may be practiced. These embodiments are described in sufficient detail to enable those skilled in the art to practice the invention, and it is to be understood that other embodiments may be utilized and that process, electrical er mechanical changes may be made without departing from the scope of the present invention. The following detailed description is, therefore, not to be taken in a limiting sense, and the scope of the present invention is defined only by the appended claims and equivalents thereof.

Figure 1:
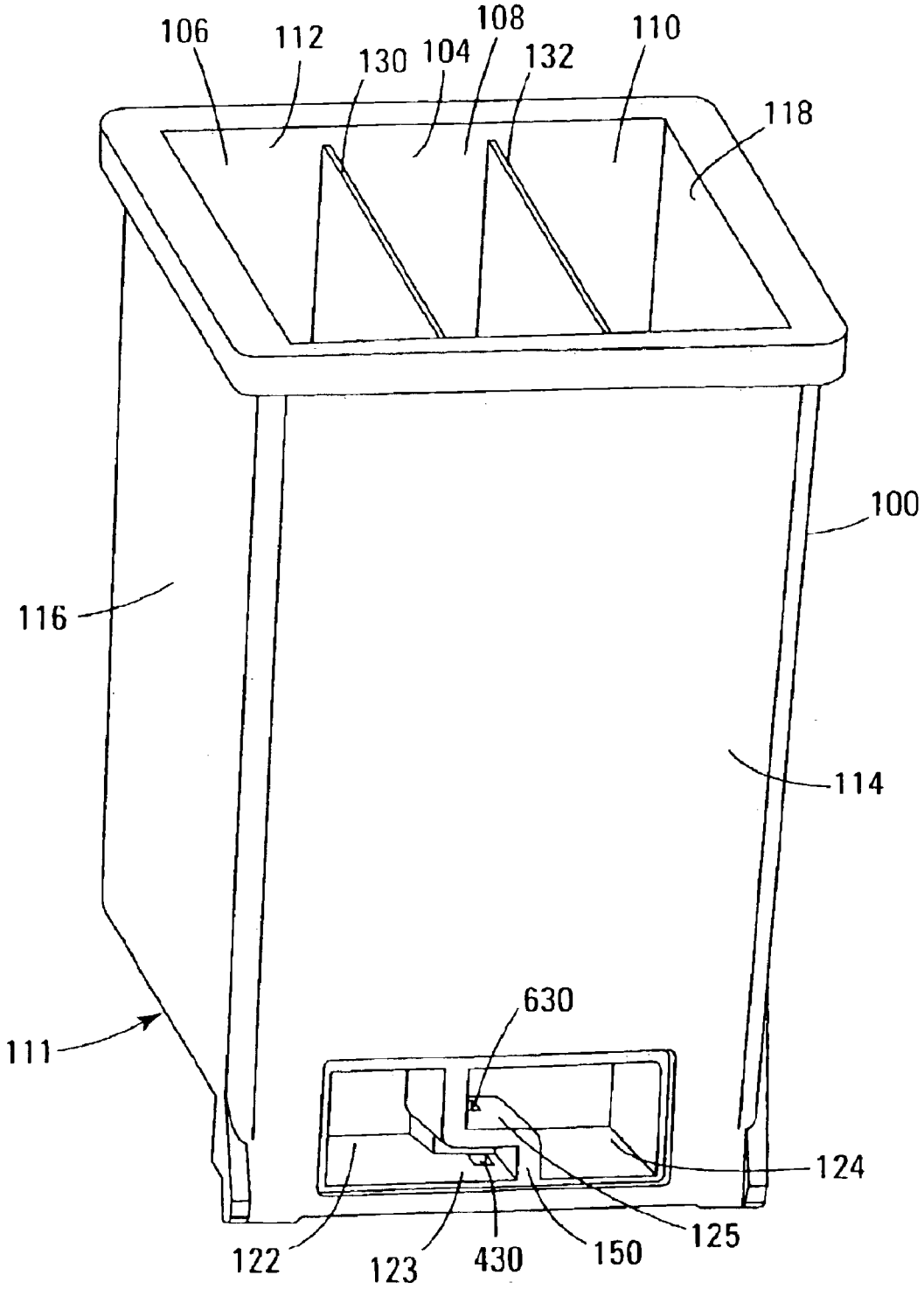
FIG. 1 is a perspective view illustrating a print cartridge body according to an embodiment of the present invention.
Figure 2:
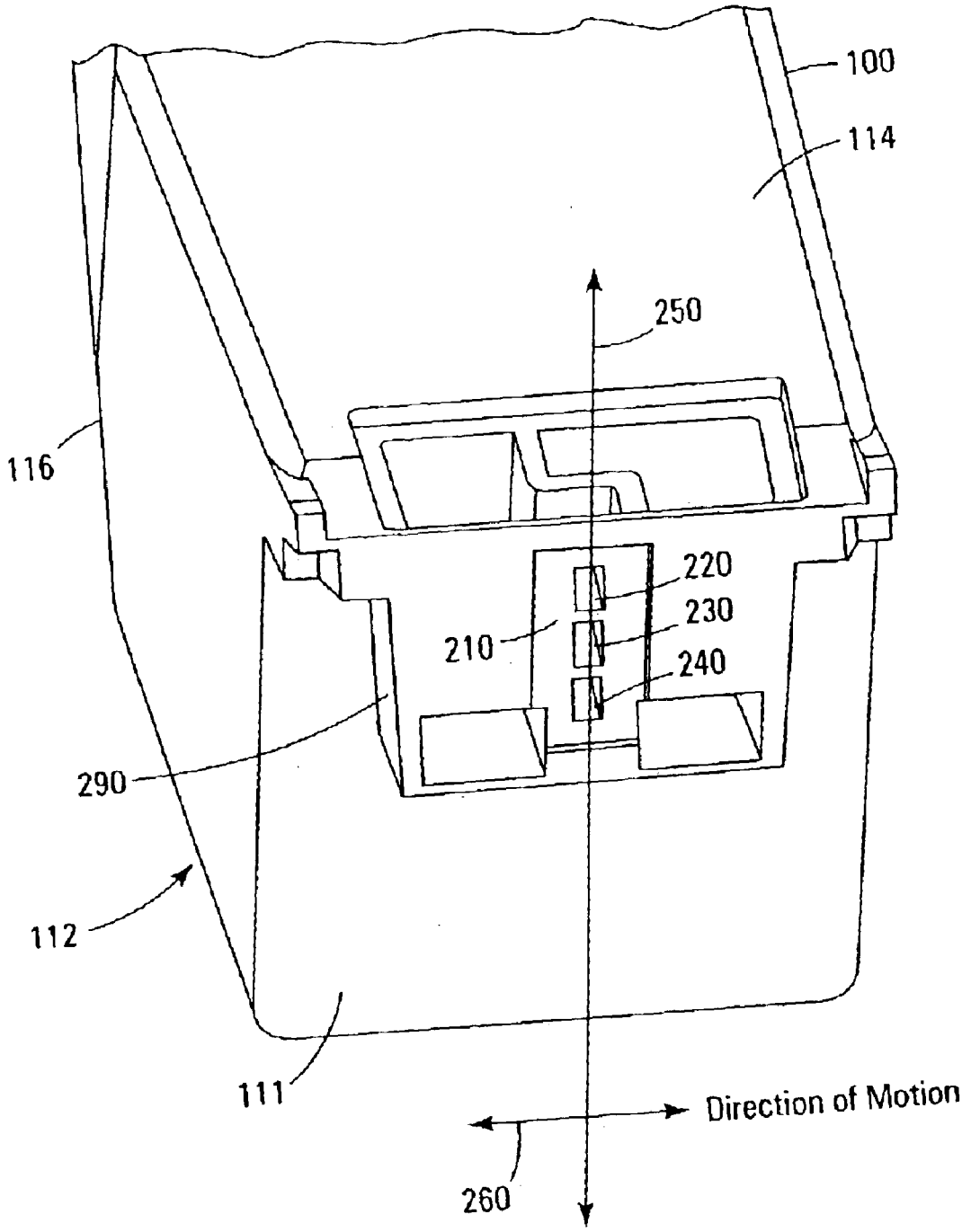
FIG. 2 is a bottom perspective view of the print cartridge body of FIG. 1.

FIG. 1 is a perspective view illustrating a print cartridge body 100 according to an embodiment of the present invention. An interior 104 of print cartridge body 100 is divided into compartments (or ink reservoirs) 106, 108, and 110, each for containing a different colored ink. In one embodiment, compartments 106, 108, and 110 are located side-by-side and are substantially parallel to each other, as shown in FIG. 1. As illustrated in FIG. 2, a bottom perspective view of print cartridge body 100, print cartridge body 100 has a print head die mounting region 210 surrounding outlet ports 220, 230, and 240 of print cartridge body 00. In one embodiment, print head die mounting region 210 and outlet ports 220, 230, and 240 are located on a wall 111 of print cartridge body 100. Outlet ports 220, 230, and 240 are aligned on a single axis 250 that is substantially perpendicular to a direction of motion of cartridge print body 100 during printing, as indicated by arrow 260.

More specifically, in one embodiment, print cartridge body 100 includes opposing walls 112 and 114. Opposing walls 112 and 114 are connected between opposing walls 116 and 118 and are substantially perpendicular to opposing walls 116 and 118. Opposing walls 112 and 1114 and opposing walls 116 and 118 define interior 104 of print cartridge body 100. In one embodiment, opposing walls 112 and 114 and opposing walls 116 and 118 are substantially perpendicular to wall 111. Partitions 130 and 132 are disposed within interior 104 and define compartments 106, 108, and 110. In one embodiment, partitions 130 and 132 are substantially parallel to each other and are substantially parallel to walls 116 and 118. Compartment 106 is located between wall 116 and partition 130, compartment 108 between partitions 130 and 132, and compartment 110 between partition 132 and wall 118.

Figure 3:
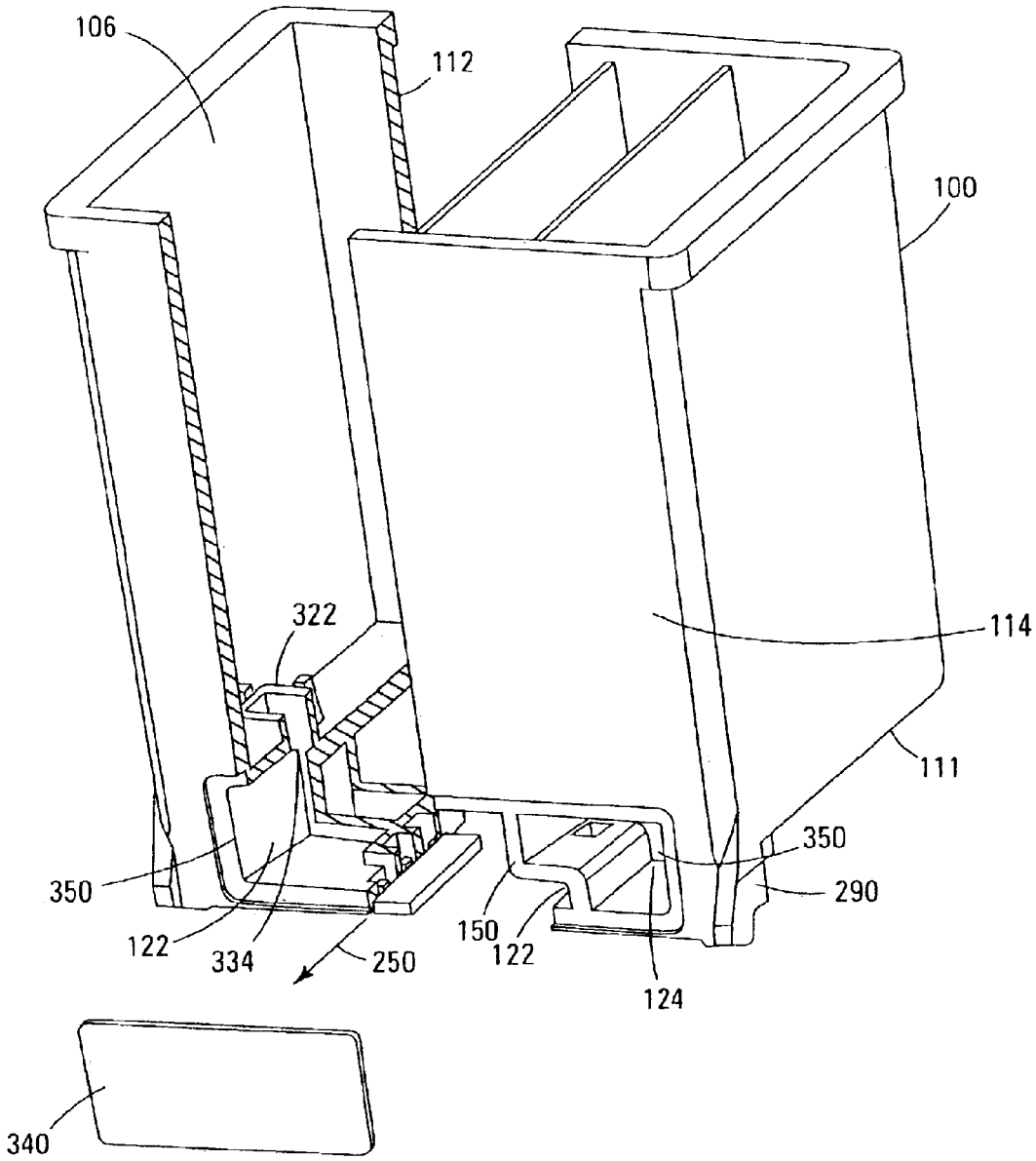
FIGS. 3 and 4 are exploded perspective views illustrating a section of the print cartridge body of FIG. 1.
Figure 4:
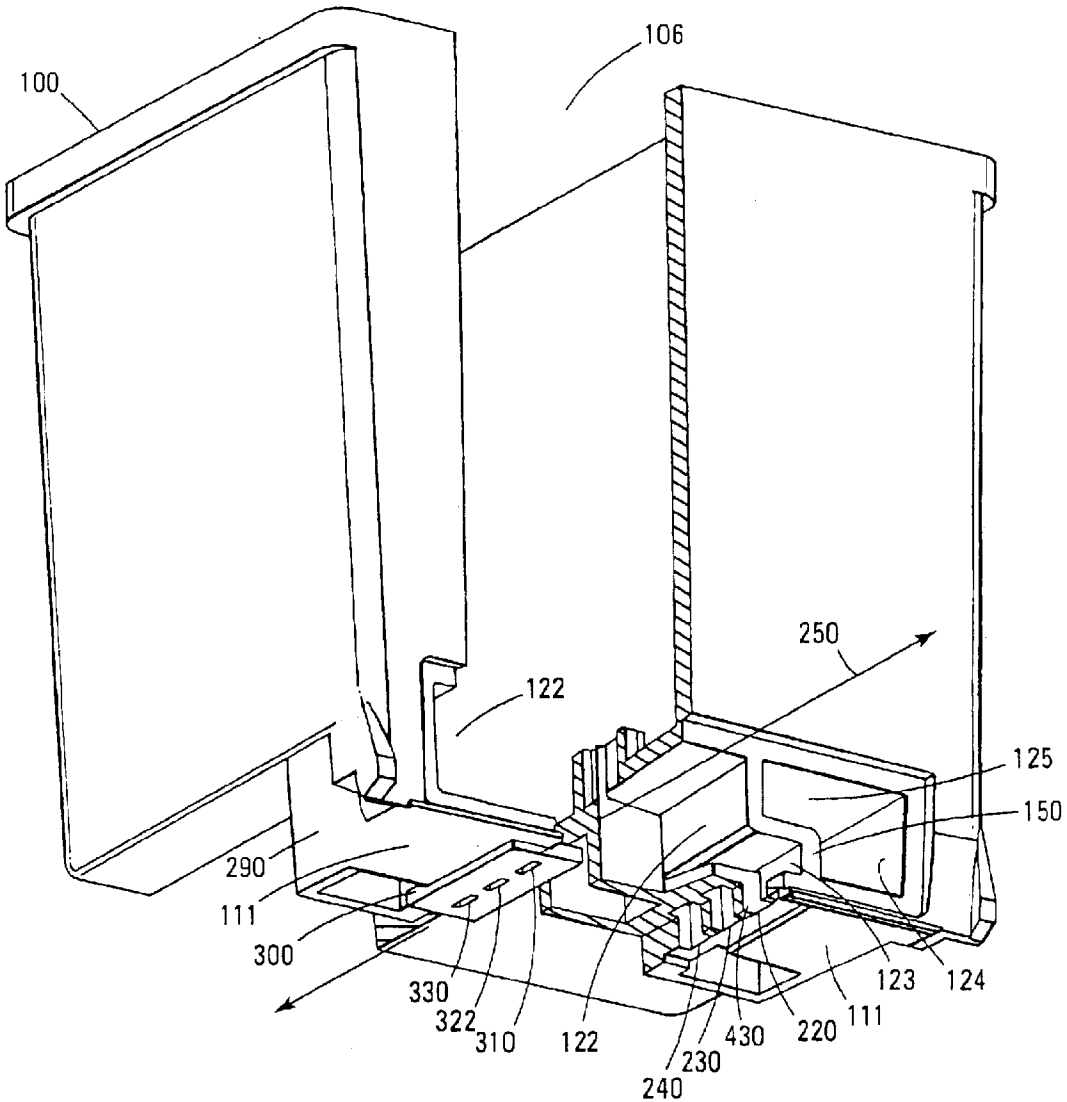

FIGS. 3 and 4 are exploded perspective views illustrating a section of print cartridge body 100. A print head die 300 is attached to print cartridge body 100 at print head die mounting region 210, as shown in FIG. 4. Print head die 300 includes slots 310, 320, and 330 aligned on axis 250. Slots 310, 320, and 330 of print head die 300 respectively align with outlet ports 220, 230, and 240, as shown in FIG. 5, a perspective view illustrating another section of print cartridge body 100.

Figure 5:
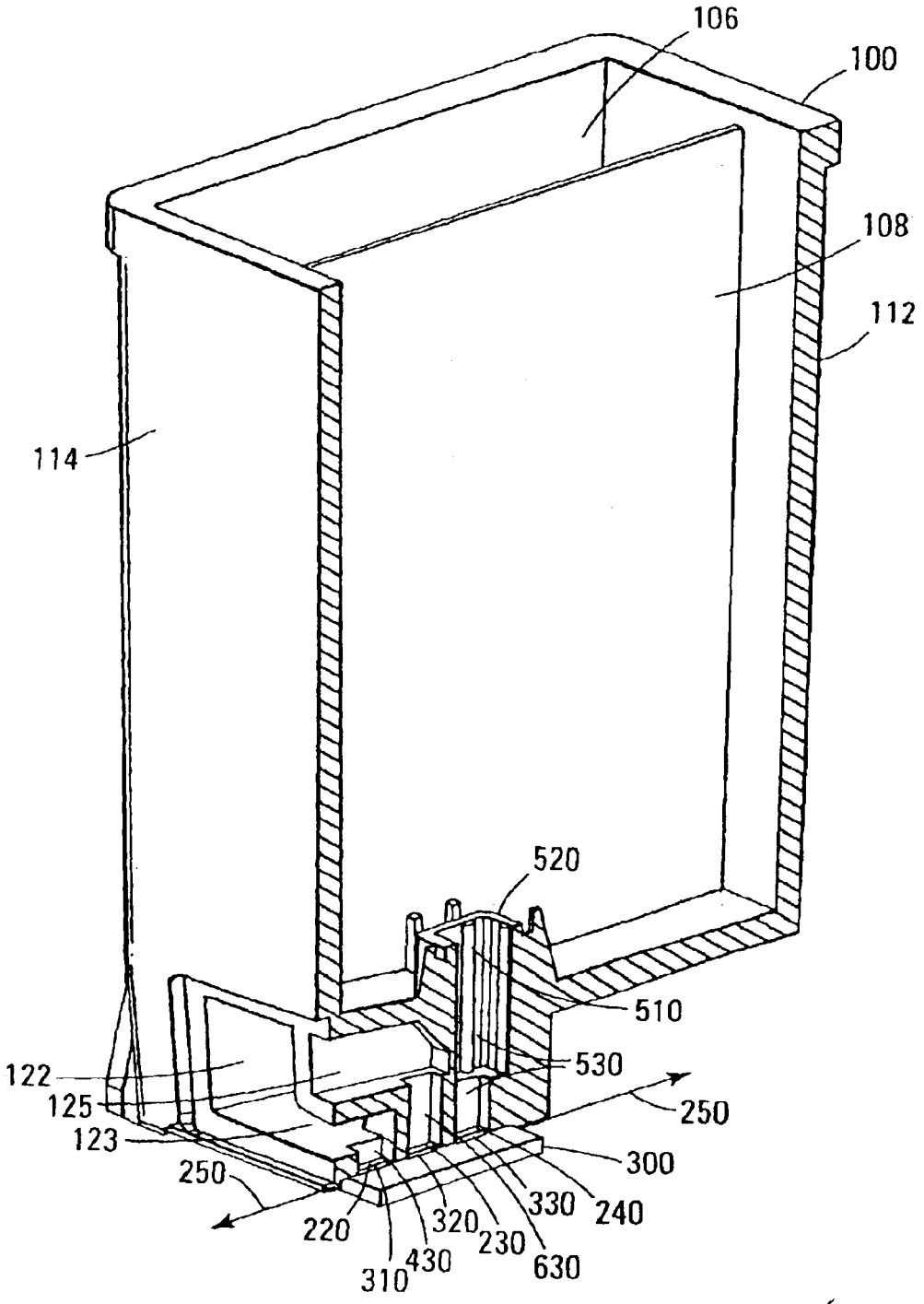
FIG. 5 is a perspective view illustrating another section of the print cartridge body of FIG. 1.

FIGS. 3–5 show that in one embodiment, compartment 106 is located laterally of print head die 300 and thus laterally of outlet ports 220, 230, and 240 and axis 250. Compartment 106 includes an exit port 334 that opens into a cavity 122 of print cartridge body 100 to communicatively couple compartment 106 and cavity 122, as shown in FIG. 3. In one embodiment, a duct (or standpipe) 322 located within compartment 106 is connected to exit port 334. A channel 123 interconnects cavity 122 and a channel 430, as shown in FIGS. 1, 3, and 4. Channel 430 passes through print cartridge body 100 to connect channel 123 to outlet port 220, as shown in FIGS. 4 and 5. Channel 123 is substantially perpendicular to axis 250. In one embodiment, cavity 122 is located laterally of outlet ports 220, 230, and 240 and axis 250, as shown in FIGS. 3 and 5.

In one embodiment, compartment 108 is centered between compartments 106 and 110, as shown in FIG. 1. In another embodiment, axis 250 substantially bisects print cartridge body 100, as shown in FIG. 2, and thus compartment 108. Compartment 108 includes an exit port 510, as shown in FIG. 5. In one embodiment, a duct (or standpipe) 520 located within compartment 108 is connected to exit port 510. A channel 530 interconnects outlet port 240 and exit port 510 of compartment 108. In one embodiment, channel 530 is substantially perpendicular to axis 250 and channel 123.

Figure 6:
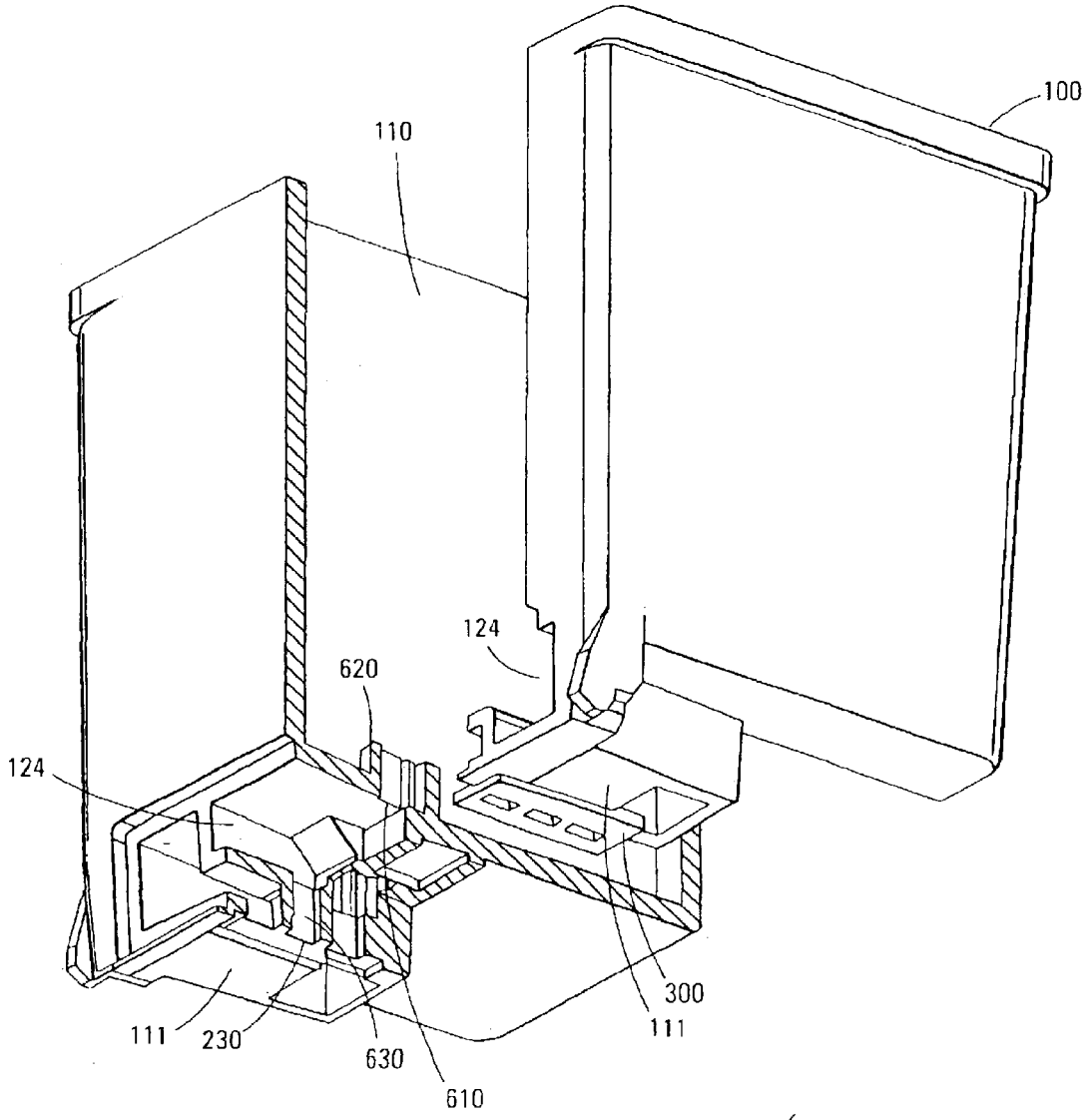
FIGS. 6 and 7 are exploded perspective views illustrating yet another section of the print cartridge body of FIG. 1.
Figure 7:
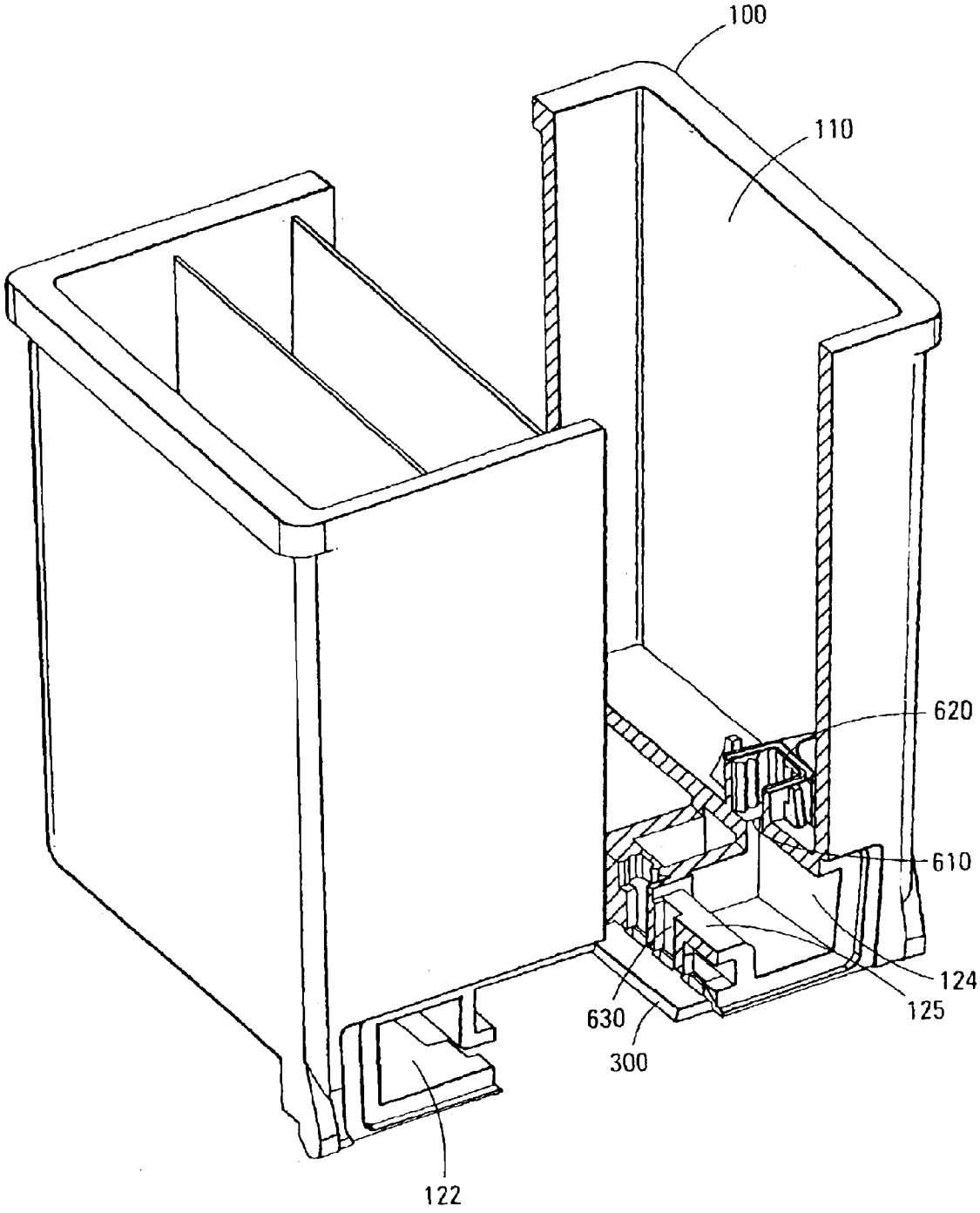

FIGS. 6 and 7 are exploded perspective views illustrating another section of print cartridge body 100. FIGS. 6 and 7 show that in one embodiment, compartment 110 is located laterally of print head die 300 and thus laterally of outlet ports 220, 230, and 240 and axis 250. In various embodiments, compartments 108 and 110 are located on opposite sides of axis 250 and outlet ports 220, 230, and 240 and thus print head die 300.

Compartment 110 includes an exit port 610 that opens into a cavity 124 of print cartridge body 100 to communicatively couple compartment 110 and cavity 124. In one embodiment, a duct (or standpipe) 620 located within compartment 110 is connected to exit port 610. A channel 125 interconnects cavity 124 and a channel 630, as shown in FIGS. 1 and 7. Channel 630 passes through print cartridge body 100 to connect channel 125 to outlet port 220, as shown in FIGS. 5 and 6.

Channel 125 is substantially perpendicular to axis 250, substantially perpendicular to channel 530, and substantially parallel to channel 123. Further, as shown in FIGS. 1 and 4 for one embodiment, a stepped divider 150 separates channels 123 and 125 and enables channels 123 and 125 to overlap. In one embodiment, cavity 124 is located laterally of outlet ports 220, 230, and 240 and axis 250, as shown in FIG. 7.

In one embodiment, print cartridge body 100 is formed as a single piece, for example, by injection molding. In this embodiment, cavity 122 and channel 123 and cavity 124 and channel 125 are formed by a single mold-slide-insert having two prongs, one for integrally forming cavity 122 and channel 123 and one for integrally forming cavity 124 and channel 125. In another embodiment, print cartridge body 100 includes a cap 340 disposed over an aperture 350 (or a mold-slide-insert access hole) in wall 114 that opens to cavities 122 and 124 and channels 123 and 125, as shown in FIG. 3. Cap 340 forms a bounding wall for cavity 122 and channel 123 and for cavity 124 and channel 125. In one embodiment, cap 340 forms a portion of wall 114 and seals aperture 350. In another embodiment, cavities 122 and 124 extend substantially parallel to axis 250 in a direction into print cartridge body 100 from aperture 350 toward wall 112, as shown in FIG. 3. In another embodiment, stepped divider 150 extends in a direction into print cartridge body 100 from aperture 350 toward wall 112.

In other embodiments, cavities 122 and 124, channels 123 and 125, and channels 430, 530, and 630 are disposed within a protrusion 290 of wall 111 of print cartridge body 100, as shown in FIGS. 2 and 3, and form an ink delivery system. In one embodiment, cavity 122 is located between wall 111 and compartment 106, and cavity 124 is located between wall 111 and compartment 110 as shown in FIGS. 4 and 6. In another embodiment, channels 430, 530, and 630 are located in substantially the same plane as outlet ports 220, 230, and 240 and thus slots 310, 320, and 330 of print head die 300, as shown in FIG. 5. In other embodiments, channels 430, 530, and 630 are of different lengths, e.g., channel 630 is longer than channel 430 and channel 530 is longer than channel 630, as shown in FIG. 5. In one embodiment, channels 430, 530, and 630 are substantially parallel to each other. In another embodiment, channels, 430 and 630 are substantially perpendicular to axis 250 and to channels 122 and 124, as shown in FIGS. 1 and 5.

In operation, duct 322 directs ink from compartment 106 through exit port 334 into cavity 122. Channel 123 directs the ink from compartment 106 substantially perpendicular to axis 250 into channel 430 from cavity 122. Channel 430 directs the ink from compartment 106 through outlet port 220 into slot 310 of print head die 300. In one embodiment, channel 123 directs the ink from compartment 106 inwardly toward outlet port 220 from cavity 122.

Duct 620 directs ink from compartment 110 through exit port 610 into cavity 124. Channel 125 directs the ink from compartment 110 substantially perpendicular to axis 250 into channel 630 from cavity 124. Channel 630 directs the ink from compartment 110 through outlet port 230 into slot 320 of print head die 300. In one embodiment, channels 123 and 125 respectively direct their respective inks substantially parallel and counter to each other. In another embodiment, stepped divider 150 directs the ink from compartment 110 that flows within channel 125 over the ink from compartment 106 that flows within channel 123. In another embodiment, channel 125 directs the ink from compartment 110 inwardly toward outlet port 230 from cavity 124.

Duct 520 directs ink from compartment 108 through exit port 510. Channel 530 directs the ink from compartment 108 through outlet port 240 into slot 330 from exit port 510. In one embodiment, channel 530 directs the ink from compartment 108 substantially perpendicular to axis 250 and substantially perpendicular to the ink within channels 223 and 225.

Figure 8:
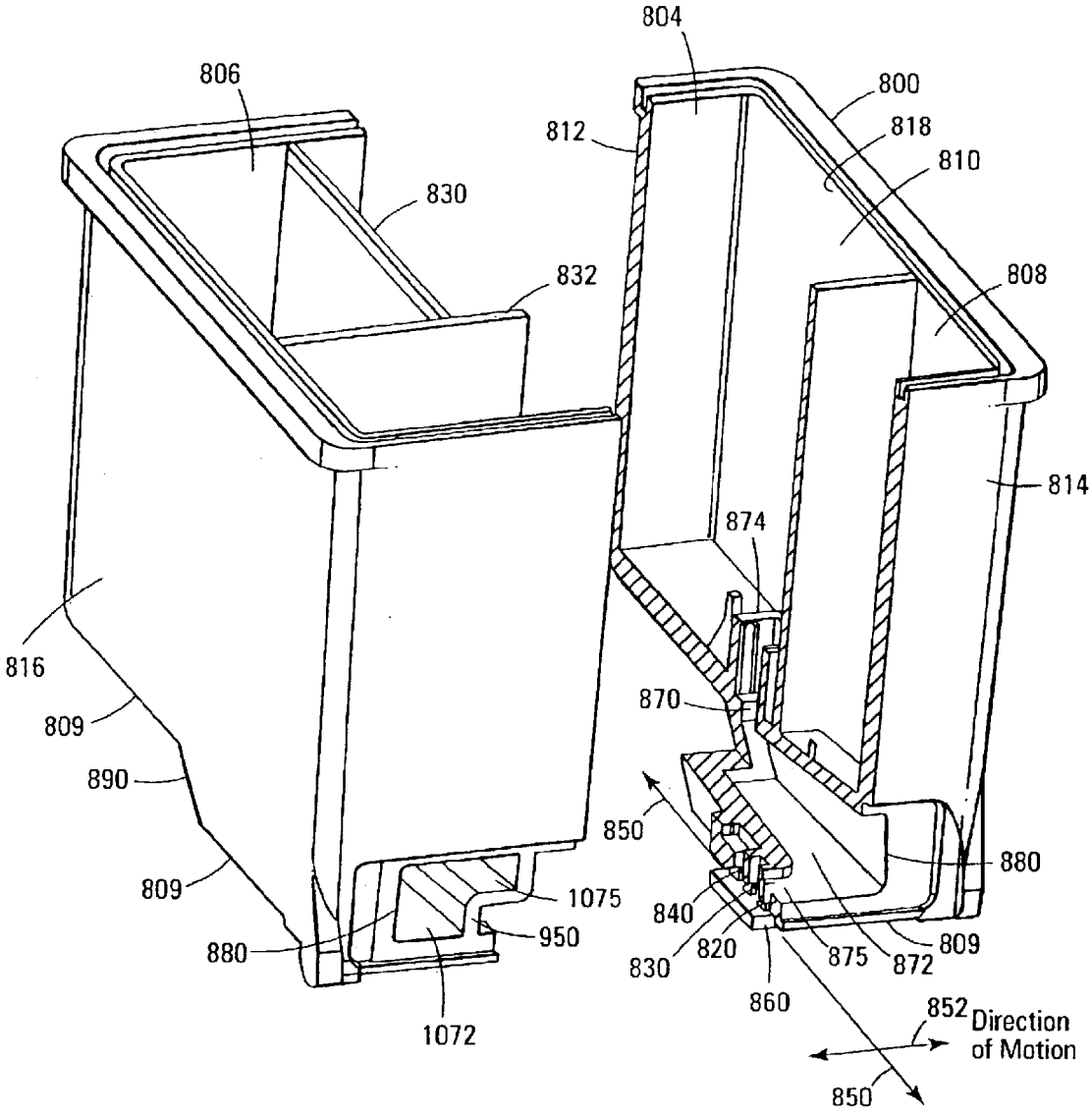
FIGS. 8 and 9 are exploded perspective views illustrating a section of print cartridge body according to another embodiment of the present invention.
Figure 9:
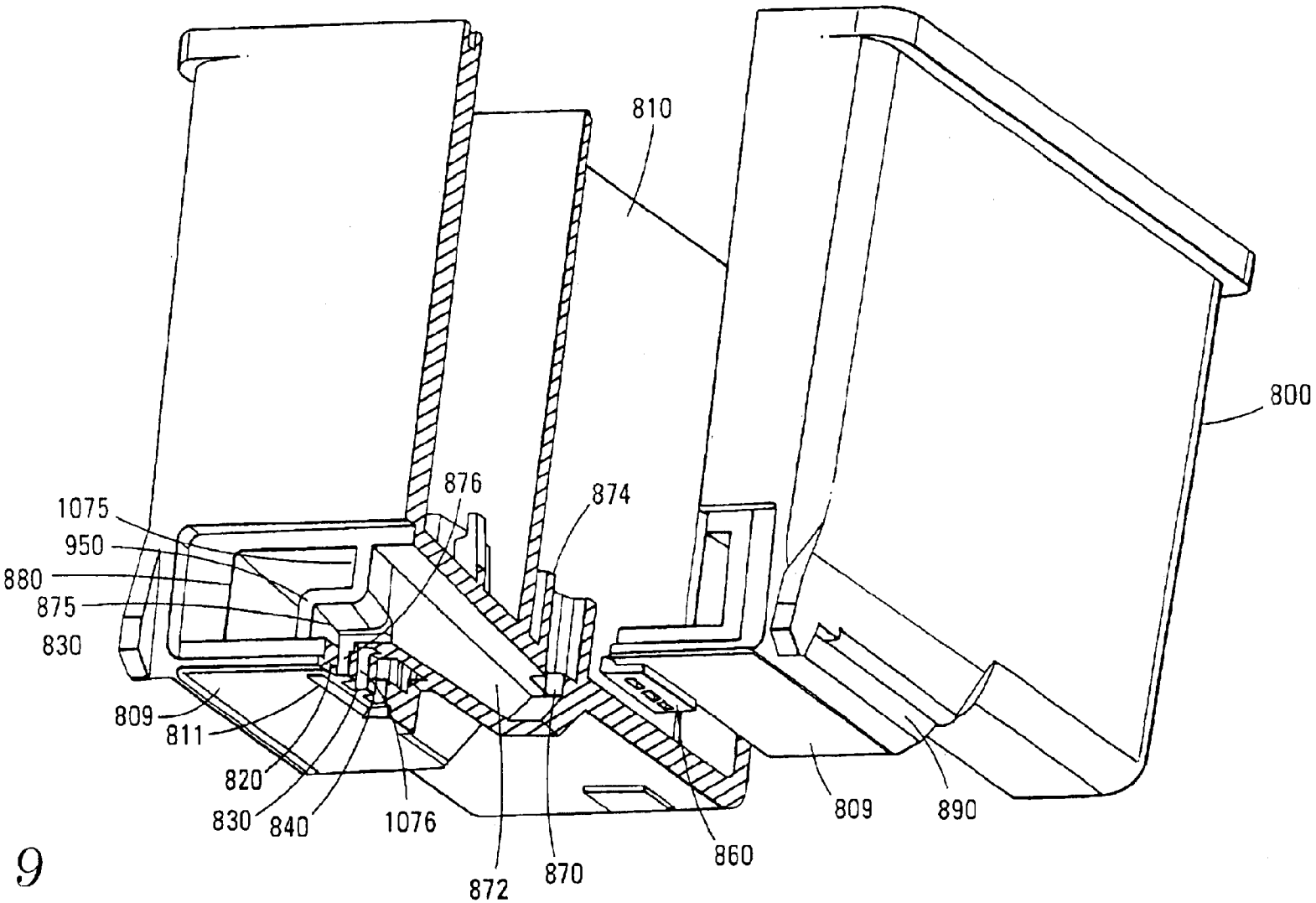
Figure 10:
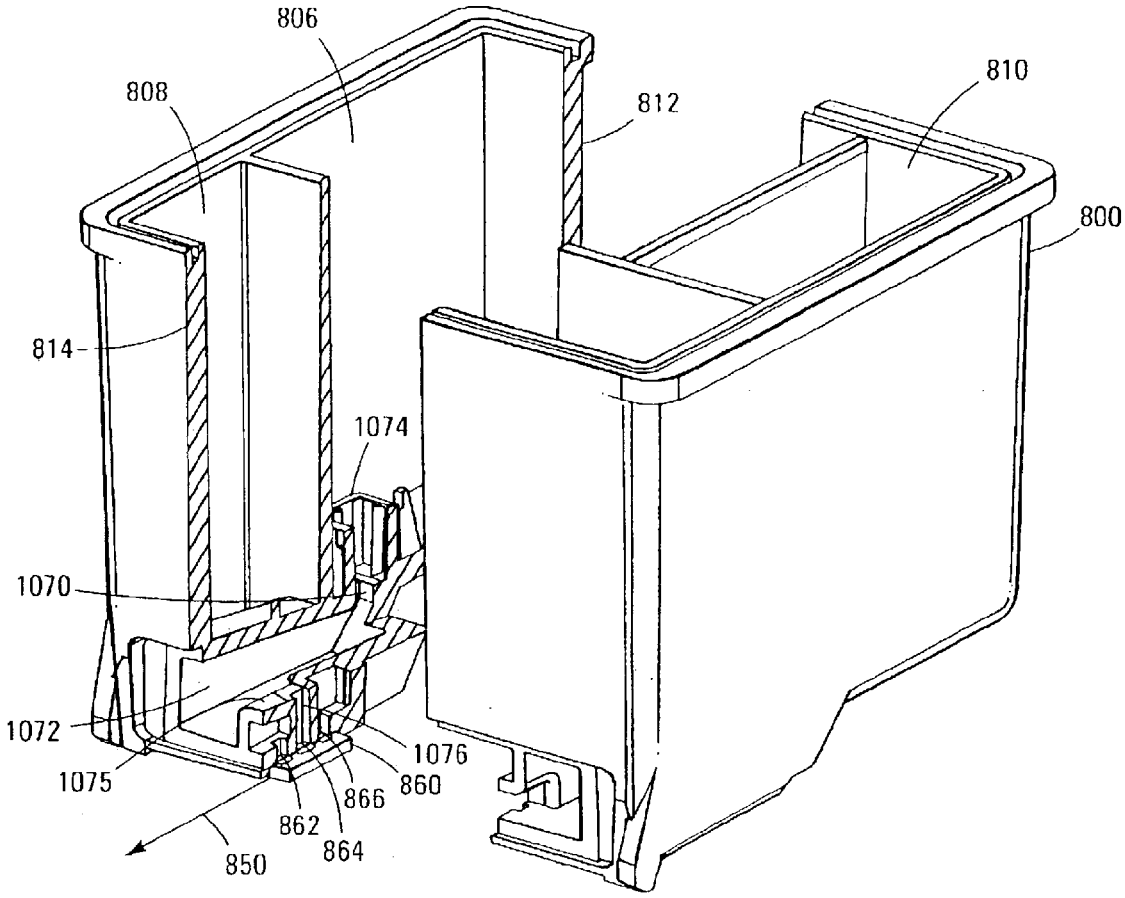
FIG. 10 is an exploded perspective view illustrating another section of the print cartridge body of FIGS. 8 and 9.
Figure 11:
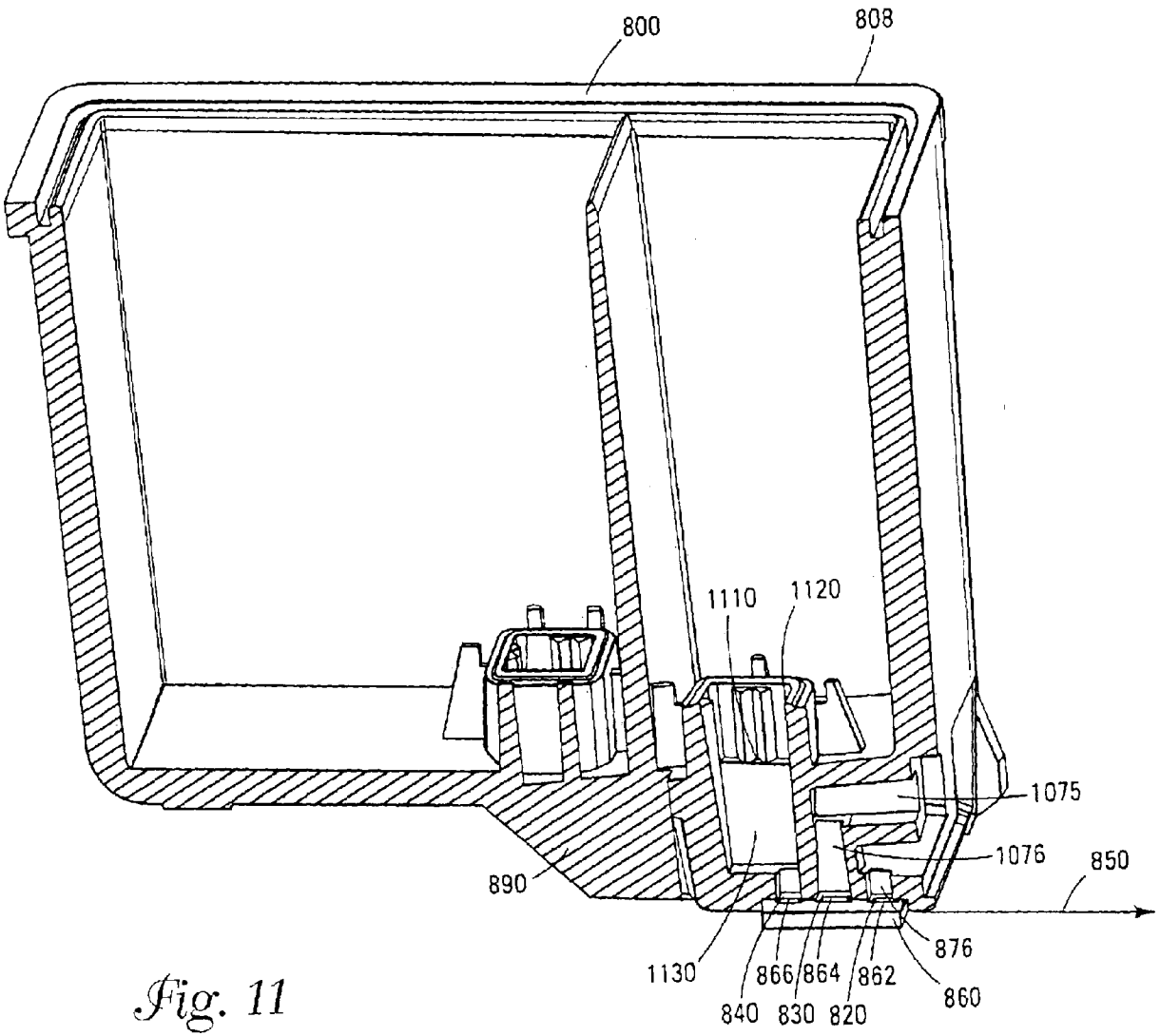
FIG. 11 is a perspective view illustrating yet another section of the print cartridge body of FIGS. 8 and 9.

FIGS. 8–11 illustrate a print cartridge body 800 according to other embodiments of the present invention. FIGS. 8 and 9 are exploded perspective views illustrating a section of print cartridge body 800. FIG. 10 is an exploded perspective view illustrating another section of print cartridge body 800. FIG. 11 is a perspective view illustrating another section of print cartridge body 800.

An interior 804 of print cartridge body 800 is divided into compartments (or ink reservoirs) 806, 808, and 810, each for containing a different colored ink. In one embodiment, compartments 806 and 810 are located side-by-side and are substantially parallel to each other, whereas compartment 808 is substantially perpendicular to compartments 806 and 810, as shown in FIG. 8. Print cartridge body 800 has a print head die mounting region 811 surrounding outlet ports 820, 830, and 840 of print cartridge body 800, as shown in FIG. 9. In one embodiment, print head die mounting region 811 and outlet ports 220, 230, and 240 are located on a wall 809 of print cartridge body 800. Outlet ports 820, 830, and 840 are aligned on a single axis 850, as shown in FIG. 8, that is substantially perpendicular to a direction of motion of cartridge body 800 during printing, as indicated by arrow 852.

FIG. 8 shows that in one embodiment, print cartridge body 800 includes opposing walls 812 and 814. Opposing walls 812 and 814 are connected between opposing walls 816 and 818 and are substantially perpendicular to opposing walls 816 and 818. Opposing walls 812 and 814 and opposing walls 816 and 818 define interior 804 of print cartridge body 800. In one embodiment, opposing walls 812 and 814 and opposing walls 816 and 818 ire substantially perpendicular to wall 809. In one embodiment, compartment 808 is located between compartments 804 and 806 and wall 814 and is substantially parallel to opposing walls 812 and 814.

Partitions 830 and 832 are disposed within interior 804 to form a substantial T-shape and define compartments 806, 808, and 810. In one embodiment, partitions 830 and 832 are substantially perpendicular to each other, with partition 830 substantially parallel to opposing walls 812 and 814 and partition 833 substantially parallel to opposing walls 816 and 818. Walls 812 and 816 and partitions 830 and 832 bound compartment 806. Walls 812 and 818 and partitions 830 and 832 bound compartment 810. Walls 814, 816, and 818 and partitions 830 and 832 bound compartment 808.

A print head die 860 is attached to print cartridge body 800 at print head die mounting region 811, as shown in FIG. 8. Print head die 860 includes slots 862, 864, and 866 aligned on axis 850, as shown in FIGS. 10 and 11. Slots 862, 864, and 866 of print head die 860 respectively align with outlet ports 820, 830, and 840, as shown in FIG. 11.

FIG. 8 shows that in one embodiment, compartment 810 is located laterally of print head die 860 and thus laterally of outlet ports 820, 830, and 840 and axis 850. Compartment 810 includes an exit port 870 that opens into a cavity 872 of print cartridge body 800 to communicatively couple compartment 810 and cavity 872. In one embodiment, a duct (or standpipe) 874 located within compartment 810 is connected to exit port 870. A channel 875 interconnects cavity 872 and a channel 876, as shown in FIG. 9. Channel 876 passes through print cartridge body 800 to connect channel 875 to outlet port 820, as shown in FIG. 9. Channel 875 is substantially perpendicular to axis 850, as shown in FIG. 8. In one embodiment, cavity 872 is substantially parallel to axis 850 and is located laterally of outlet ports 820, 830, and 840 and axis 850, as shown in FIG. 8.

FIG. 10 shows that in one embodiment, compartment 806 is located laterally of print head die 860 and thus laterally of outlet ports 820, 830, and 840 and axis 850. In various embodiments, compartments 806 and 810 are located on opposite sides of axis 850 and outlet ports 820, 830, and 840 and thus print head die 860. Compartment 806 includes an exit port 1070 that opens into a cavity 1072 of print cartridge body 800 to communicatively couple compartment 806 and cavity 1072. In one embodiment, a duct (or standpipe) 1074 located within compartment 806 is connected to exit port 1070. A channel 1075 interconnects cavity 1072 and a channel 1076. Channel 1076 passes through print cartridge body 800 to connect channel 1075 to outlet port 830, as shown in FIG. 9. Channel 1075 is substantially perpendicular to axis 850, as shown in FIG. 8. In one embodiment, cavity 872 is substantially parallel to axis 850 and is located laterally of outlet ports 820, 830, and 840 and axis 850, as shown in FIG. 10. For one embodiment, a stepped divider 950 separates channels 875 and 1075 and enables channels 875 and 1075 to overlap, as shown in FIG. 9.

FIG. 11 shows that compartment 808 includes an exit port 1110. In one embodiment, a duct (or standpipe) 1120 located within compartment 808 is connected to exit port 1110. A channel 1130 interconnects outlet port 840 and exit port 1110 of compartment 808. In one embodiment, channel 1130 is substantially perpendicular to axis 850 and channels 875 and 1075, as shown in FIG. 11.

In one embodiment, print cartridge body 800 is formed as a single piece, for example, by injection molding. In this embodiment, cavity 872 and channel 875 and cavity 1072 and channel 1075 are formed by a single mold-slide-insert having two prongs, one for integrally forming cavity 872 and channel 875 and one for integrally forming cavity 1072 and channel 1075. In another embodiment, print cartridge body 800 includes a cap, such as cap 340 of FIG. 3, disposed over an aperture 880 (or a mold-slide-insert access hole) in wall 814 that opens to cavities 872 and 1072 and channels 875 and 1075, as shown in FIG. 8. The cap forms a bounding wall for cavity 872 and channel 875 and for cavity 1072 and channel 1075. In one embodiment, the cap forms a portion of wall 814. In another embodiment, cavities 872 and 1072 extend substantially parallel to axis 850 in a direction into print cartridge body 800 from aperture 880 toward wall 812, as shown in FIG. 8. In another embodiment, stepped divider 950 extends in a direction into print cartridge body 800 from aperture 880 toward wall 812.

In other embodiments, cavities 872 and 1072, channels 875 and 1075, and channels 876, 1076, and 1130 are disposed within a protrusion 890 of wall 809 of print cartridge body 800, as shown in FIGS. 8, 9, and 11, and form an ink delivery system. In one embodiment, cavities 872 and 1072 and channels 875 and 1075 are located between wall 809 and compartment 808, as shown in FIG. 8. In other embodiments, channels 876, 1076, and 1130 are located in substantially the same plane as outlet ports 820, 830, and 840 and thus slots 862, 864, and 866 of print head die 860, as shown in FIG. 11. In one embodiment, channels 876, 1076, and 1130 are of different lengths, e.g., channel 1076 is longer than channel 876 and channel 1130 is longer than channel 1076, as shown in FIG. 11. In another embodiment, channels 876, 1076, and 1130 are substantially parallel to each other, as shown in FIG. 11. In another embodiment, channels 876 and 1076 are substantially perpendicular to axis 850 and channels 875 and 1075, as shown in FIGS. 9 and 11.

In operation, duct 874 directs ink from compartment 810 through exit port 870 into cavity 872. In one embodiment, cavity 872 directs the ink from compartment 810 substantially parallel to axis 850 to channel 875. Channel 875 directs the ink from compartment 810 substantially perpendicular to axis 850 into channel 876 from cavity 872. Channel 876 directs the ink from compartment 810 through outlet port 820 into slot 862 of print head die 860. In one embodiment, channel 875 directs the ink from compartment 810 inwardly toward outlet port 820 from cavity 872.

Duct 1074 directs ink from compartment 806 through exit port 1070 into cavity 1072. In one embodiment, cavity 1072 directs the ink from compartment 806 substantially parallel to axis 850 to channel 1075. Channel 1075 directs the ink from compartment 806 substantially perpendicular to axis 850 into channel 1076 from cavity 1072. Channel 1076 directs the ink from compartment 806 through outlet port 830 into slot 864 of print head die 860. Channels 875 and 1075 respectively direct their respective inks substantially parallel and counter to each other. In one embodiment, stepped divider 950 directs the ink from compartment 806 that flows within channel 1075 over the ink from compartment 810 that flows within channel 875. In one embodiment, channel 1075 directs the ink from compartment 806 inwardly toward outlet port 830 from cavity 1072.

Duct 1120 directs ink from compartment 808 through exit port 1110. Channel 1130 directs the ink from compartment 808 through outlet port 840 into slot 866 from exit port 1110. In one embodiment, channel 1130 directs the ink from compartment 808 substantially perpendicular to axis 850 and substantially perpendicular to the ink within channels 875 and 1075.

Figure 12:
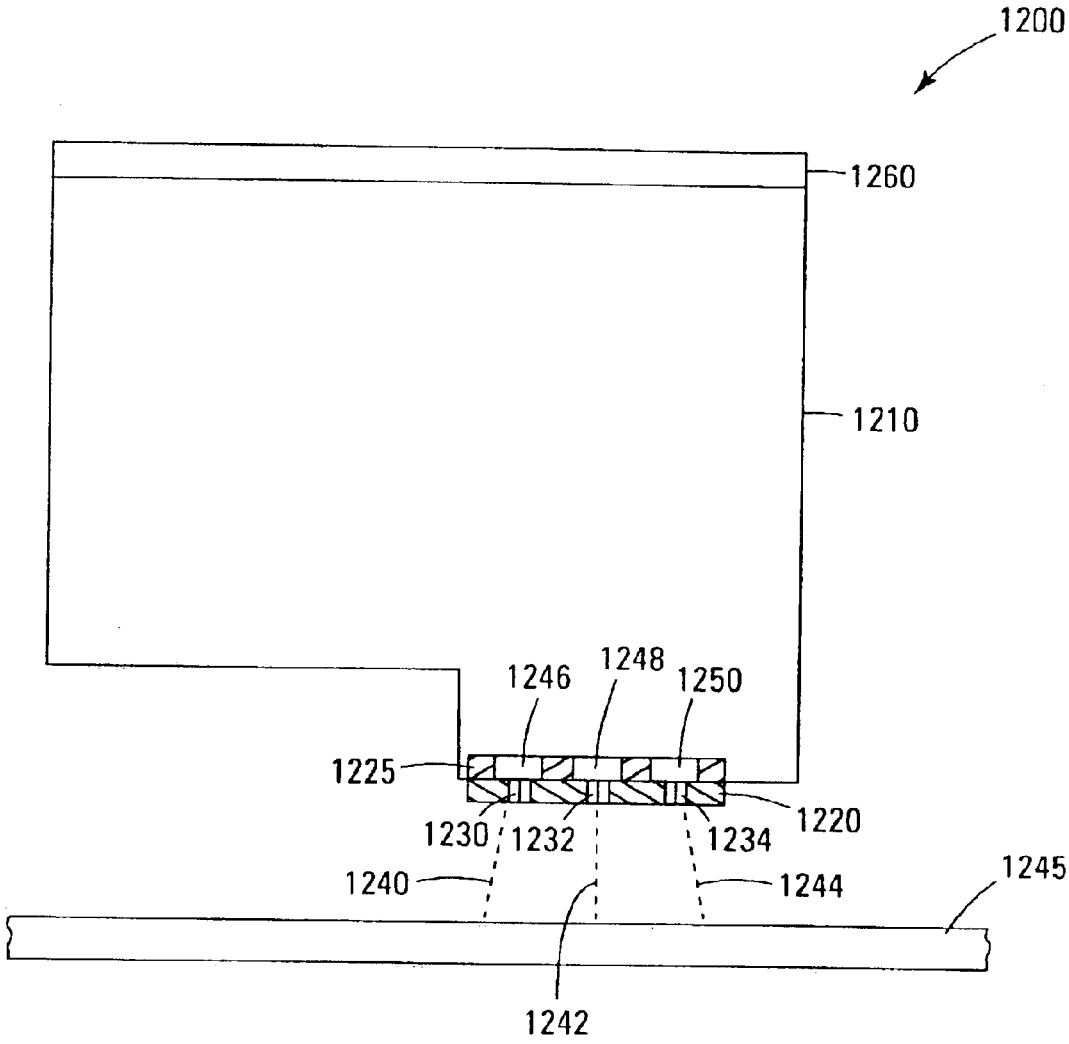
FIG. 12 is a side view of a print cartridge according to another embodiment of the present invention.

FIG. 12 is a side view of a print cartridge 1200, such as an ink-jet cartridge, according to another embodiment of the present invention. Print cartridge 1200 includes a print cartridge body 1210. For some embodiments, print cartridge body 1210 is as described above for print cartridge body 100 of FIGS. 1–7. For other embodiments, print cartridge body 1210 is as described above for print cartridge body 800 of FIGS. 8–11. Print cartridge 1200 includes a print head 1220 that includes a print head die 1225. In one embodiment, print head die 1225 is as described above for print head die 300 of FIGS. 4–6. In another embodiment, print head die 1225 is as described above for print head die 860 of FIGS. 8–11. A cover 1260 is attached to print cartridge body 1210, e.g., opposite print head 1220.

Print head 1220 includes orifice sets 1230, 1232, and 1234 respectively for expelling ink droplets 1240, 1242, and 1244 onto a printable medium 1245, e.g., paper, during printing. In one embodiment, orifice sets 1230, 1232, and 1234 respectively receive a different colored ink from slots 1246, 1248, and 1250 of print head 1220. In another embodiment, slots 1246, 1248, and 1250 are respectively as described above for slots 310, 320, and 330 of print head die 300, and in yet another embodiment, slots 1246, 1248, and 1250 are respectively as described above for slots 860, 862, and 863 of print head die 860.

In one embodiment, ink is delivered from print cartridge body 1210 to print head die 1225 as described above for print cartridge body 100 and print head die 300. In another embodiment, ink is delivered from print cartridge body 1210 to print head die 1225 as described above for print cartridge body 800 and print head die 860. That is, slots 1246, 1248, and 1250 respectively receive ink from a different compartment of print cartridge body 1200, such: as compartments 106, 108, and 110 of print cartridge body 100 or compartments 806, 808, and 810 of print cartridge body 800.

CONCLUSION

Although specific embodiments have been illustrated and described herein, it will be appreciated by those of ordinary skill in the art that any arrangement that is calculated to achieve the same purpose may be substituted for the specific embodiments shown. Many adaptations of the invention will be apparent to those of ordinary skill in the art. Accordingly, this application is intended to cover any adaptations or variations of the invention. It is manifestly intended that this invention be limited only by the following claims and equivalents thereof.

What is claimed is:

1. A single-piece print cartridge body comprising:

a plurality of outlet ports disposed along a single axis that is substantially perpendicular to a direction of motion of the print cartridge body during printing;

first and second compartments respectively communicatively coupled to first and second cavities, the first and second cavities substantially parallel to the single axis and located on opposite sides of the single axis;

a first channel interconnecting the first cavity and a first one of the plurality of outlet ports; and a second channel interconnecting the second cavity and a second one of the plurality of outlet ports;

wherein the first and second channels are substantially perpendicular to the single axis.

2. The print cartridge body of claim 1, further comprising a third channel connected between the first channel and first outlet port and a fourth channel connected between the second channel and second outlet port.

3. The print cartridge body of claim 2, wherein the third and fourth channels are located in substantially the same plane as the plurality of slots.

4. The print cartridge body of claim 3, wherein the third and fourth channels are substantially parallel to each other and are substantially perpendicular to the single axis and the first and second channels.

5. The print cartridge body of claim 4, wherein the third and fourth channels are of different lengths.

6. The print cartridge body of claim 1, further comprising first and second ducts respectively located in the first and second compartments and respectively connected to the first and second cavities.

7. The print cartridge body of claim 1, further comprising an aperture in one wall of the print cartridge body that opens to the first and second cavities and the first and second channels.

8. The print cartridge body of claim 1, further comprising a print-head-die mounting region surrounding the plurality of outlet ports.

9. The print cartridge body of claim 1, further comprising a third compartment connected to a third one of the plurality of outlet ports by a third channel.

10. The print cartridge body of claim 9, wherein the third channel is substantially perpendicular to the single axis and the first and second channels.

11. The print cartridge body of claim 9, wherein the third compartment is located between and is substantially parallel to the first and second compartments.

12. The print cartridge body of claim 9, wherein the third compartment is substantially perpendicular to the first and second compartments.

13. The print cartridge body of claim 9, further comprising a duct located in the third compartment connected to the third channel.

14. The print cartridge body of claim 1, further comprising a stepped divider disposed between the first and second channels for enabling the first and second channels to overlap.

15. A single-piece print cartridge body comprising:

opposing first and second walls connected between opposing third and fourth walls to define an interior of the print cartridge body, the first and second walls substantially perpendicular to the third and fourth walls;

a fifth wall that is substantially perpendicular to the first, second, third, and fourth walls having a print-head-die mounting region surrounding a plurality of outlet ports, the plurality of outlet ports disposed along a single axis that is substantially perpendicular to a direction of motion of the print cartridge body during printing;

first and second compartments located within the interior of the print cartridge body on opposite sides of the single axis;

first and second cavities extending from an aperture in the first wall toward the second wall, the first and second cavities substantially parallel to the single axis and respectively communicatively coupled to the first and second compartments, the first and second cavities respectively located on the same sides of the single axis as the first and second compartments;

a first channel interconnecting the first cavity and a first one of the plurality of outlet ports, the first channel substantially perpendicular to the single axis;

a second channel interconnecting the second cavity and a second one of the plurality of outlet ports, the second channel substantially perpendicular to the single axis; and a third compartment connected to a third one of the plurality of outlet ports by a third channel.

16. The print cartridge body of claim 15, further comprising a fourth channel connected between the first channel and first outlet port and a fifth channel connected between the second channel and second outlet port.

17. The print cartridge body of claim 16, wherein the third, fourth, and fifth channels are located in substantially the same plane as the plurality of slots.

18. The print cartridge body of claim 17, wherein the third, fourth, and fifth channels are substantially parallel to each other and are substantially perpendicular to the single axis and the first and second channels.

19. The print cartridge body of claim 18, wherein the third, fourth, and fifth channels are of different lengths.

20. The print cartridge body of claim 15, wherein the third channel is substantially perpendicular to the single axis and the first and second channels.

21. The print cartridge body of claim 15, wherein the third compartment is located between and is substantially parallel to the first and second compartments.

22. The print cartridge body of claim 15, wherein the third compartment is substantially perpendicular to the first and second compartments.

23. The print cartridge body of claim 22, wherein the third compartment is located between the first and second compartments and the first wall and is substantially parallel to the first and second walls.

24. The print cartridge body of claim 15, wherein the first and second cavities and the first and second channels are disposed within a protrusion of the fifth wall.

25. The print cartridge body of claim 15, wherein the print-head-die mounting region is disposed on a protrusion of the fifth wall.

26. A single-piece print cartridge body comprising:

means for containing a first ink;

means for receiving the first ink from the first ink containing means, the first ink receiving means substantially perpendicular to a direction of motion of the print cartridge body during printing;

means for directing the first ink substantially parallel to the direction of motion between the first ink receiving means and a first outlet port;

means for containing a second ink;

means for receiving the second ink from the second ink containing means, the second ink receiving means substantially perpendicular to the direction of motion; and means for directing the second ink substantially parallel to the direction of motion between the second ink receiving means and a second outlet port aligned with the first outlet port on a single axis that is substantially perpendicular to the direction of motion.

27. The print cartridge body of claim 26, further comprising:

means for containing a third ink; and means for directing the third ink from the third ink containing means to a third outlet port aligned with the first and second outlet ports on the single axis.

28. The print cartridge body of claim 27, wherein the third ink containing means is located between and is substantially parallel to the first and second ink containing means.

29. The print cartridge body of claim 27, wherein the third ink containing means is substantially perpendicular to the first and second ink containing means.

30. An ink-jet cartridge comprising:

a single-piece body comprising:

a plurality of outlet ports disposed along a single axis that is substantially perpendicular to a direction of motion of the ink-jet cartridge during printing;

first and second compartments respectively communicatively coupled to first and second cavities, the first and second cavities substantially parallel to the single axis and located on opposite sides of the single axis;

a first channel interconnecting the first cavity and a first one of the plurality of outlet ports, the first channel substantially perpendicular to the single axis;

a second channel interconnecting the second cavity and a second one of the plurality of outlet ports, the second channel substantially perpendicular to the single axis; and a third compartment connected to a third one of the plurality of outlet ports by a third channel;

a pint head attached to the single-piece body, the print head comprising a plurality slots, the slots respectively aligning with the outlet ports; and a single cap disposed over an aperture in one wall of the single-piece body that opens to the first and second cavities and the first and second channels.

31. The inkjet cartridge of claim 30, wherein the third channel is substantially perpendicular to the single axis and the first and second channels.

32. The ink-jet cartridge of claim 30, further comprising a fourth channel connected between the first channel and first outlet port and a fifth channel connected between the second channel and second outlet port.

33. The ink-jet cartridge of claim 32, wherein the third, fourth, and fifth channels are located in substantially the same plane as the plurality of slots.

34. The ink-jet cartridge of claim 33, wherein the third, fourth, and fifth channels are substantially parallel to each other and are substantially perpendicular to the single axis and the first and second channels.

35. The inkjet cartridge of claim 30, wherein the third compartment is located between and is substantially parallel to the first and second compartments.

36. The ink-jet cartridge of claim 30, wherein the third compartment is substantially perpendicular to the first and second compartments.

37. The inkjet cartridge of claim 30, further comprising a cover attached to the single-piece body opposite the print head.

38. A method for delivering ink to a print head of a print cartridge, the method comprising:

directing first and second inks respectively from first and second compartments of a single-piece print cartridge body of the print cartridge respectively into first and second cavities of the print cartridge body, wherein the first and second cavities are substantially perpendicular to a direction of motion of the print head during printing and are located on opposite sides of the print head;

directing the first ink substantially parallel to the direction of motion from the first cavity through a first channel to a second channel that is located in substantially the same plane as a plurality of slots of the print head, wherein the slots are aligned on a single axis substantially perpendicular to the direction of motion;

directing the second ink substantially parallel to the direction of motion from the second cavity through a third channel, in a direction counter to the first ink through the first channel, to a fourth channel that is located in substantially the same plane as the plurality of slots and the second channel; and directing the first and second inks respectively through the second and fourth channels respectively into first and second slots of the plurality of slots.

39. The method of claim 38, further comprising directing a third ink from a third compartment of the cartridge body into a third slot of the plurality of slots.

40. The method of claim 39, wherein directing a third ink from a third compartment of the cartridge body into a third slot of the plurality of slots comprises directing the third ink through a fifth channel located in substantially the same plane as the plurality of slots and the second and fourth channels.

41. The method of claim 39, wherein directing a third ink from a third compartment of the cartridge body comprises directing the third ink from a third compartment located between and substantially parallel to the first and second compartments.

42. The method of claim 39, wherein directing a third ink from a third compartment of the cartridge body comprises directing the third ink from a third compartment located substantially perpendicular to the first and second compartments.

43. The method of claim 38, wherein directing first and second inks respectively from first and second compartments of a single-piece print cartridge body comprises directing the first and second inks respectively from first and second compartments respectively located on the same sides of print head as the first and second cavities.

44. The method of claim 38, further comprising directing the first and second inks substantially perpendicular to the direction of motion respectively within the first and second cavities.

* * * * *

UNITED STATES PATENT AND TRADEMARK OFFICE

CERTIFICATE OF CORRECTION

PATENT NO. : 6,851,800 B1
APPLICATION NO. : 10/629204
DATED : February 8, 2005
INVENTOR(S) : Preston Seu It is certified that error appears in the above-identified patent and that said Letters Patent is hereby corrected as shown below:

IN THE SPECIFICATION

Column 2, Line 59, after “electrical” delete “er” and insert therefor --or--

Column 3, Line 8, after “body” delete “00” and insert therefor --100--

Column 5, Line 55, after “818” delete “ire” and insert therefor --are--

IN THE CLAIMS

Column 11, Line 7, delete “pint” and insert therefor --print--

Signed and Sealed this

Tenth Day of June, 2008

JON W. DUDAS
*Director of the United States Patent and Trademark Office*